US005816218A

United States Patent [19]

Motose

[11] Patent Number: 5,816,218

[45] Date of Patent: Oct. 6, 1998

[54] MULTI-CYLINDER ENGINE CONTROL

[75] Inventor: Hitoshi Motose, Hamamatsu, Japan

[73] Assignee: Sanshin Kogyo Kabushiki Kaisha, Hamamatsu, Japan

[21] Appl. No.: 612,248

[22] Filed: Mar. 7, 1996

[30] Foreign Application Priority Data

Mar. 7, 1995 [JP] Japan ..... 7-046900

[51] Int. Cl.[6] ..... F02D 41/22; F02P 11/00

[52] U.S. Cl. ..... 123/414; 123/479

[58] Field of Search ..... 123/414, 479, 123/630, 643, 417

[56] References Cited

U.S. PATENT DOCUMENTS 4,494,518 1/1985 Katayama et al. ..... 123/643 X
4,960,092 10/1990 Sasaki et al. ..... 123/414
5,213,079 5/1993 Umemoto et al. ..... 123/414
5,239,962 8/1993 Fukui et al. ..... 123/414
5,494,017 2/1996 Miyata et al. ..... 123/414

*Primary Examiner*—Tony M. Argenbright
*Attorney, Agent, or Firm*—Knobbe, Martens, Olson & Bear LLP

[57] ABSTRACT

A number of embodiments of engine control systems wherein fuel injection and spark timing is controlled by individual sensors associated with each of the combustion chambers. This provides more accurate fuel-air control and ignition control, particularly when operating at low speeds when the angular rotational speed of the crankshaft may vary significantly during a single revolution. However, the system includes a fail-safe mode that will provide continued operation in the event an output is not received from one or more sensors. In this event, the timing of the fuel injection and/or ignition is controlled by the output from another sensor. The timing may be done simultaneously from that other sensor output, or in a timed interval after that other sensor output.

23 Claims, 10 Drawing Sheets

MULTI-CYLINDER ENGINE CONTROL

BACKGROUND OF THE INVENTION

This engine relates to a multi-cylinder engine control and more particularly to an engine control having separate timing devices for controlling at least one event in each cylinder.

It is well known in engine operation that a number of the systems associated with each of the cylinders require operation at certain timed events. For example, when fuel injection systems are employed, and generally regardless of whether they are manifold or direct injection systems, the duration of fuel injection and also the timing of fuel injection is controlled so as to occur at a specific time in the events of the specific associated cylinder. In a similar manner, spark-ignited engines employ spark plugs that are fired at specific time intervals in the timing within the cylinder.

For simplicity, it has been proposed to use a single sensor that is normally associated with the engine output shaft and which gives a signal at a specific angle of that output shaft. This signal is then used for controlling the timing of all of the controlled events of each cylinder. This is done by one of a variety of methods that require computing from the single output shaft angle signal the actual timing for each cylinder.

Although such systems have the advantage of simplicity and low cost, there are some instances where they may not provide the desired, optimum running conditions. The reason for this is that the single sensor type of system assumes that the angular rotation speed of the engine output shaft is constant during a single rotation. Although this is generally true, it is not absolutely correct. This is particularly true under some running conditions wherein the instantaneous speed of rotation of the output shaft can vary significantly during a single revolution. Since the events in the combustion chambers occur cyclically, the driving impulses on the engine output shaft are not totally uniform throughout a single revolution, or even through several revolutions. Therefore, the single sensor type of timing mechanism may not provide the desired timing control.

It has been proposed, therefore, to use arrangements wherein there are a plurality of sensors, normally one for each combustion chamber. Therefore, the controlled timing events for each combustion chamber can be controlled by their respective timing sensor, and irregularities in instantaneous crankshaft rotational speed do not adversely affect the cylinder-to-cylinder timing.

Although these types of multi-sensor devices can provide more accurate control, even they can have some difficulties. For example, when plural sensors are employed, there becomes a risk that one or more of the sensors may become inoperative or fail to send a signal at certain times. When this occurs, then the cylinder or cylinders with which the inoperative or malfunctioning sensor is associated will not operate at all. This is obviously not satisfactory.

It is, therefore, a principal object of this invention to provide an improved control method and system for a multiple combustion chamber internal combustion engine.

It is a further object of this invention to provide an improved control system for an engine having a plurality of combustion chambers and individual sensors associated with each chamber, and wherein an arrangement and method is provided whereby each cylinder continues to operate even if a sensor associated with a specific one or more cylinders becomes inoperative.

SUMMARY OF THE INVENTION

This invention is adapted to be embodied in a control system and method for an internal combustion engine having a plurality of combustion chambers. An air charging system is provided for delivering an air charge to each of the combustion chambers. A fuel system also delivers a fuel charge to each of the combustion chambers. An ignition system is provided for firing the resulting combustible charge in each of the combustion chambers for initiating combustion therein. An exhaust system discharges the burnt charge from each of the combustion chambers. An output shaft is driven by the combustion in the combustion chamber. At least one of the systems includes a plurality of timed components, one for each combustion chamber, for effecting a timed event in the portion of the system serving the respective combustion chamber. A plurality of timing sensors are provided, each associated with the output shaft for a respective one of the combustion chambers.

In accordance with a system for practicing the invention, means are provided which sense when a sensor associated with at least one of the combustion chambers fails to output its signal. In the event such a failure is sensed, means are provided for controlling the timing of the event of the timed component for that combustion chamber in another manner.

In accordance with a method for practicing the invention, the output signals of the timers are monitored to determine if any sensor fails to output a signal. If it is sensed that a timing sensor has not output a signal, then the timed component associated with that combustion chamber is operated in another manner.

DETAILED DESCRIPTION OF THE PREFERRED EMBODIMENTS OF THE INVENTION

Figure 1:
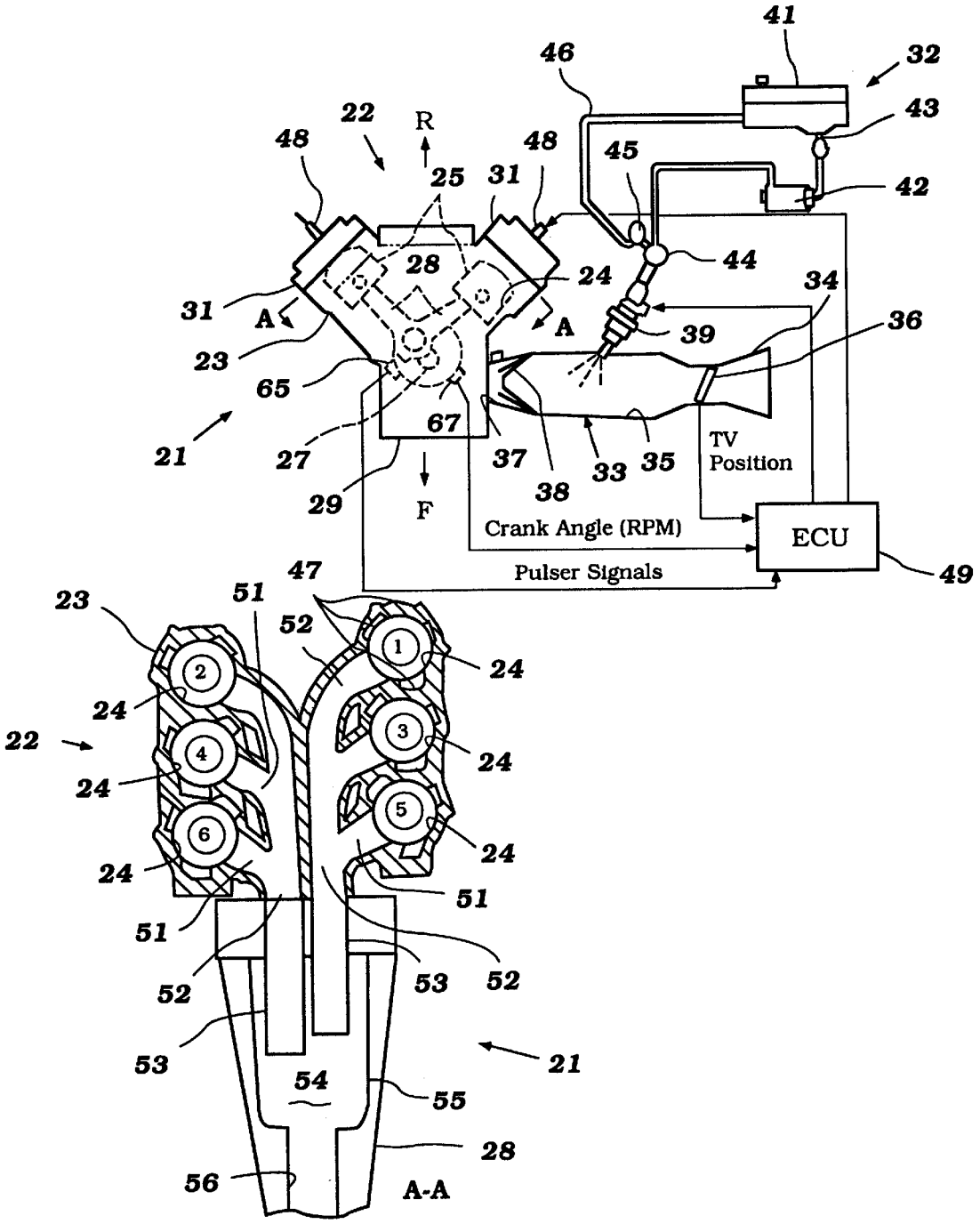
FIG. 1 is a composite view comprised of, at the top, a top plan view of the powerhead and associated systems of an outboard motor constructed and operated in accordance with an embodiment of the invention and at the bottom, an enlarged cross-sectional view taken along the line A—A of the upper view.

Referring now in detail to the drawings, and initially to FIG. 1, an outboard motor is show partially and is identified generally by the reference numeral 21. The invention is described in conjunction with an outboard motor, only as a typical environment in which the invention is adapted to be employed. The invention has particular utility, as will become apparent, in conjunction with engines having multiple combustion chambers, such as reciprocating engines, as shown in this embodiment and identified generally by the reference numeral 22 or, for that matter, rotary engines. In addition, certain facets of the invention have utility with two-cycle engines, which the engine 22 comprises, although the invention is not so limited, as will become readily apparent to those skilled in the art. Furthermore, the invention has specific utility in conjunction with engines which may be operated for long time periods at relatively low speeds. This is a typical characteristic with many applications for outboard motors wherein the engine 22 may be operated at low speeds for such time periods, for example, during trolling.

Since the invention deals primarily with the construction and operation of the control system for the engine 22, the basic structure of the engine 22 will be described only generally. Where any specific component is not illustrated or described, reference may be had to any conventional construction utilized in the art for the details of such components.

In the illustrated embodiment, the engine 22 is of the V-6 type. For the reasons already noted, it will be apparent to those skilled in the art how the invention has utility and can be practiced in conjunction with multiple cylinder engines having other configurations and other cylinder numbers. The engine 22 is, therefore, comprised of a cylinder block 23 which has a pair of angularly related cylinder banks, each of which is formed with three cylinder bores 24. It should be noted that the cylinder bores 24 are numbered as 1, 2, 3, 4, 5 and 6, to facilitate description of the invention.

As is typical with V-type engine practice and as is clearly shown in the lower portion of FIG. 1, the cylinder bores 24 of one cylinder bank and that cylinder bank are staggered relative to the other cylinder bank it its cylinder bores. The reason for this is well known in the art, but will be described subsequently.

Pistons 25 reciprocate in each of the cylinder bores 24. The pistons 25 are connected by means of connecting rods 26 to a crankshaft 27. The offsetting of the cylinder bores 24 permits the connecting rods 26 of the respective cylinder banks to be journaled on common throws of the crankshaft 27, as is also well known in this art.

As is typical with outboard motor practice, the engine 22 is mounted in the associated powerhead of the outboard motor 21 so that the crankshaft 27 rotates about a vertically extending axis. This facilitates coupling of the crankshaft 27 to a drive shaft (not shown), which depends into a drive shaft housing 28 disposed beneath this powerhead. This drive shaft then drives a propulsion unit (not shown) positioned at the lower end of the drive shaft housing 28.

These components of the outboard motor are also not illustrated because they are not necessary to permit those skilled in the art to practice the invention. Again, where any details of the outboard motor 21 are not illustrated or described, they may be considered to be of any type conventionally employed in this art.

The crankshaft 27 is rotatably journaled within a crankcase chamber formed by the skirt of the cylinder block 23 and a crankcase member 29 that is affixed thereto in any known manner. As will be described later and as is well known in the two-cycle engine practice embodying crankcase compression, the principle upon which the engine 22 operates, the crankcase chambers associated with each of the cylinder bores 24 are sealed from each other.

Cylinder head assemblies 31 are affixed to each of the cylinder banks and close the cylinder bores 24. These cylinder heads assemblies 31 have individual recesses which cooperate with the cylinder bores 24 and the heads of the pistons 25 to form the combustion chambers of the engine.

A fuel-air charge is delivered to the individual crankcase chambers of the engine by an induction and charge-forming system, indicated generally by the reference numeral 32. This charge-forming system 32 includes an air induction system and a fuel supply system, which will now be described.

The air induction system includes an air intake manifold, indicated generally by the reference numeral 33, and which includes an atmospheric air inlet device 34 that draws atmospheric air from the atmosphere. In outboard motor practice, this atmospheric air inlet is formed within a surrounding protective cowling, which is not shown in the drawings, that encircles and protects the engine 22. This cowling provides an atmospheric air inlet so that air can be drawn into the protective cowling while water is excluded. This air is then delivered into the manifold air inlet device 34.

The manifold 33 has a plurality of individual runners 35, one for each cylinder of the engine. Throttle valves 36 are mounted in these runners and are controlled by a remotely positioned operator for controlling the speed of the engine 22 in a manner well known in the art.

Each manifold runner 34 discharges into a respective one of the aforenoted sealed crankcase chambers through a respective inlet port 37. A reed-type check valve 38 is provided in each manifold runner 33 adjacent and actually at the intake ports 37 so as to permit the air charge to pass into the crankcase chambers when the respective piston 25 is moving upwardly to increase the volume in the crankcase chamber. These reed-type check valves 38 then close as the pistons 25 move downwardly to compress the charge in the crankcase chambers.

The fuel supply system of the charge-forming system 32 includes a plurality of individual fuel injectors 39. The fuel injectors 39 are of the electric solenoid-operated type and spray into the manifold runners 35.

Fuel is supplied to the fuel injectors 39 from a remotely positioned fuel tank 41. A fuel pump 42 draws the fuel from the fuel tank 41 through a filter 43 and delivers it to a fuel rail 44 that is connected to the injectors 39 for delivery of fuel thereto.

A pressure relief valve 45 is provided in the fuel rail 44 and maintains a uniform pressure therein by dumping fuel back to the fuel supply system through a return conduit 46. In the illustrated embodiment, this returned fuel is returned to the tank 41, but it can be returned any place in the system upstream of the pump 42 or, in fact, downstream of the pump, but upstream of the fuel rail 44.

Thus, a fuel-air charge is formed by the charge-forming system 32 and delivered to the individual crankcase chambers. This charge is compressed in the crankcase chamber, as aforenoted, and then is transferred to the area in the combustion chamber above the pistons 25 through suitable scavenge ports and passages, which appear in FIG. 1 and are identified by the reference numerals 42. The scavenge passages and ports 47 associated with only one of the cylinders have been numbered, but the ports for each cylinder bore 24 clearly are revealed in the lower portion of FIG. 1.

The fuel-air charge which is transferred by the scavenge passages and ports 47 into the combustion chambers is then further compressed as the pistons 25 approach top dead center. At an appropriate time, this charge is ignited by spark plugs 48 mounted in the cylinder head assemblies 31. There is one spark plug 48 supplied for each combustion chamber, although multiple spark plugs per cylinder may be employed in conjunction with the invention. These spark plugs are fired by an ignition system, which is shown schematically in FIGS. 2 and 3, and which will be described later by reference to those figures. The firing of the spark plugs 48 is controlled by a system which includes an ECU 49, which will be described later in more detail, as will certain of its control strategy.

The charge which has been ignited in the combustion chambers will expand and drive the pistons 25 downwardly in their respective cylinder bores 24. Eventually, exhaust ports 51 which are formed integrally in the cylinder block 23 will be opened so as to permit the exhaust gases to flow into a pair of exhaust manifolds 52 which are formed in side-by-side relationship integrally within the cylinder block 23.

As is typical in outboard motor practice, the exhaust manifolds 52 extend downwardly and terminate at a pair of exhaust pipes 53 which depend into the drive shaft housing 28. These exhaust pipes 53 terminate in an expansion chamber 54 formed by an inner shell 55 within the drive shaft housing 28. These exhaust gases are then delivered to the atmosphere through a suitable marine exhaust system, which includes an underwater exhaust gas discharge (not shown) which communicates with a discharge section 56 of the expansion chamber.

Figure 2:
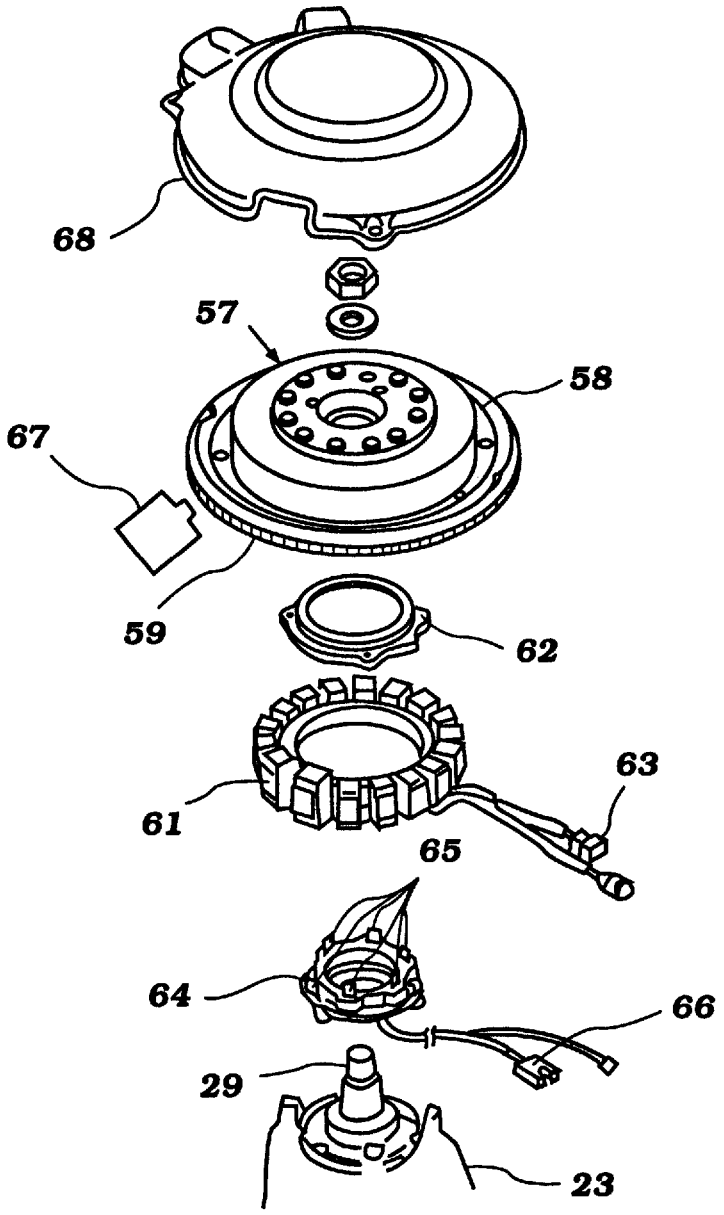
FIG. 2 is an exploded perspective view showing the flywheel magneto and associated timing mechanism for the engine.
Figure 3:
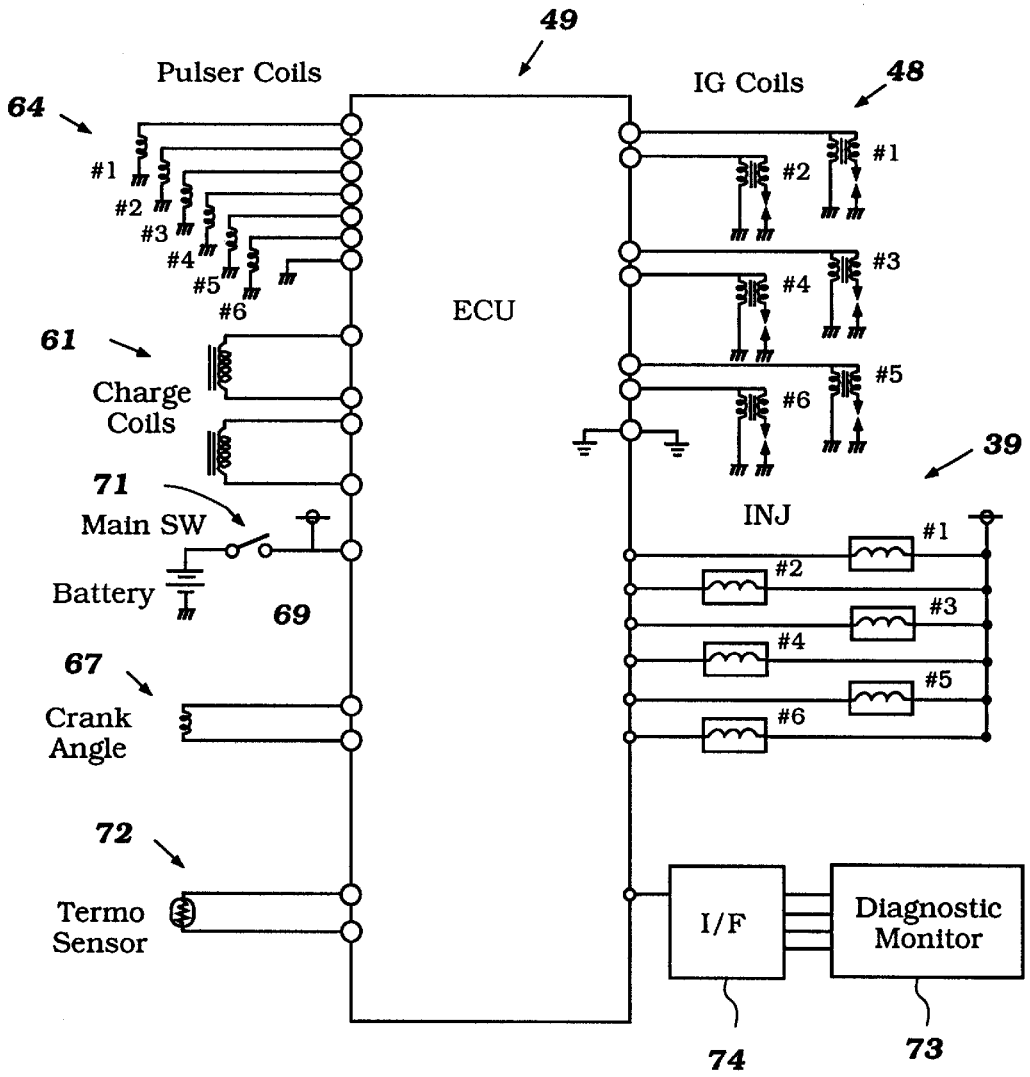
FIG. 3 is a partially schematic electrical diagram of the engine.

The ignition system and certain components associated with the remaining engine control system, including that by which the ECU 49 controls the timing and duration of injection of fuel from the fuel injectors 39, will now be described by particular reference to FIG. 2, although it should be noted that certain of these components are also shown in FIGS. 1 and 3.

Associated with the upper end of the crankshaft 29 is a flywheel magneto assembly, indicated generally by the reference numeral 57, and which includes a flywheel portion 58 having an inner periphery on which are mounted a plurality of permanent magnets, in a manner well known in this art. A starter gear 59 is affixed to the outer peripheral edge of the flywheel 58 and cooperates with an associated starter motor (not shown) for starting of the engine 22. These starter gear teeth 59 are also utilized for another purpose, as will become apparent.

Fixed to the upper end of the cylinder block 23 in surrounding relationship to the crankshaft 29 is a charging coil ring 61. This ring is held in place by a retainer plate 62 and includes a plurality of coils that cooperate with the permanent magnets carried by the flywheel magneto assembly 58 for generating an output current which is utilized not only for the ignition system, to be described, but which also may be employed for charging a battery or powering electrical accessories associated with the watercraft powered by the outboard motor 21. A wiring harness 63 is provided for carrying the electrical current generated away from the charging coil ring 61.

Mounted concentrically with the charging coil 61 ring is a pulser ring 64 which is also held in place by the retainer plate 62 and encircles the crankshaft 29. This pulser ring 64 has a number of individual probes 65, one for each cylinder of the engine, and each of which outputs an output pulse signal, as will become apparent, upon rotation of the flywheel magneto assembly 58 so as to provide a signal indicative of the timing relationship of each cylinder 1, 2, 3, 4, 5 and 6. Again, a wire harness 66 carries these output signals.

Finally, a crank angle sensor 67 is mounted on the cylinder block 23 in an appropriate manner in proximity to the teeth of the starter gear 59. This crank angle sensor outputs a signal also to the ECU through an appropriate harness, which is not shown. This signal may be employed to measure the actual speed of the engine by counting the number of pulses in a given time interval. It is also used for timing purposes, as will be described.

This entire assembly is covered by a cover plate 68 that is affixed to the cylinder block 23 in surrounding relationship while permitting access to the starter gear teeth 59 for starting purposes.

Referring now to the electrical schematic of FIG. 3, it will be seen that, as previously noted, the output from the pulser coil ring 64, and specifically the individual pulser probes, is output to the ECU 49, as is the output from the charging coil 61. Also, the output from the crank angle sensor 67 is also outputted to the ECU 49. The ECU 49 is also connected to a main battery 69 through a main switch 71. Certain other signals may be outputted to the ECU 49 for engine control purposes, and these include an engine temperature sensor switch 72, which will provide a warning signal if the temperature of the engine 22 exceeds a predetermined amount.

In addition to these signals, which are shown in FIGS. 1 and 3 also, the engine is provided with a number of other sensors which output signals to the ECU 49 for engine control, and these may include a throttle position sensor whose output is shown in FIG. 1, that provides a signal indicative of the position of the throttle valve 36. This gives the ECU 49 an indication of engine load. Since the basic control strategy for the engine, except for the fail-safe modes for defects in sensor outputs, as will be described, an understanding of the basic control strategy is not necessary to permit those skilled in the art to practice the invention. It will be obvious to those skilled in the art how the invention may be practiced with any known control systems.

Returning again to FIG. 3, it should be seen that each of the spark plugs 48 has associated with it a respective ignition coil. These ignition coils are triggered by the ECU 49 in a timed sequence in accordance with any desired ignition timing control strategy. Again, however, those skilled in the art may refer to any known type of strategy for the manner in which this is done. Also, the electrically operated fuel injectors 39 have individual solenoid coils which are also triggered by the ECU 49 in accordance with any known type of standard control strategy. Also, as will become apparent, the strategy includes an arrangement for controlling the individual fuel injectors and/or spark plugs 48 by an alternative method in the event of such failures.

This failure operation is controlled by a diagnostic monitor 73 that transmits signals back and forth to the ECU through a communications interface 74. These control strategies will now be described by reference first to FIG. 4.

Figure 4:
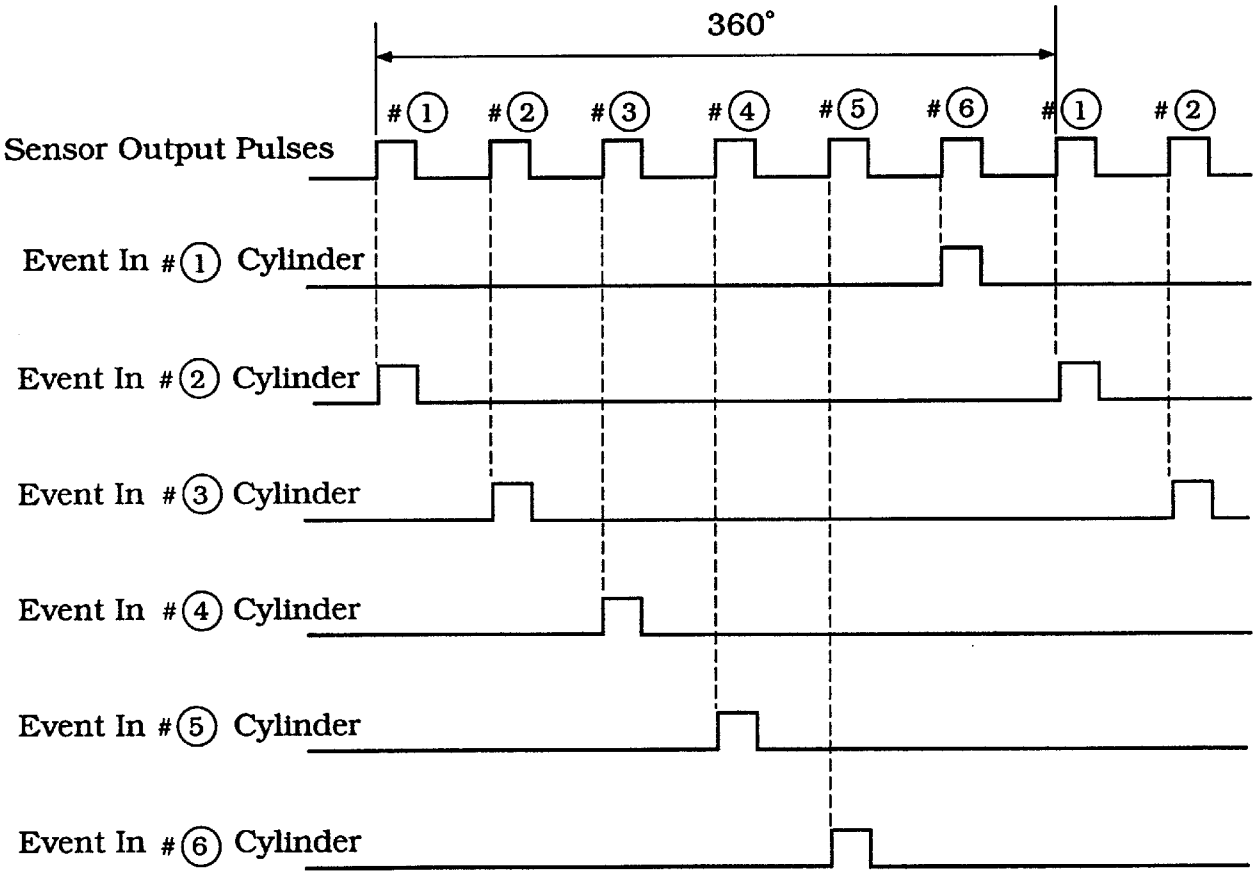
FIG. 4 is a graphical timing diagram showing the output pulses of each of the timing sensors and the timing of the respective event in the cylinders when the sensors are all operative and providing output signals.

FIG. 4 is an injector timing diagram for an engine wherein the engine is operating normally and all of the sensor probes 65 of the sensor assembly 64 are outputting their pulse signals, as indicated across the top line of this figure. These signals are processed by the ECU 49 to output pulses to the solenoids of the individual fuel injectors 39 in the desired firing sequence. FIG. 4 shows a firing sequence in the order of 2, 3, 4, 5, 6, 1. This sequence is described for illustration purposes only, and it will be readily apparent to those skilled in the art how the invention can be practiced in conjunction with other sequences.

Similar timing pulses are employed for initiating the firing of the spark plugs 48. It should be noted, however, that the actual firing is not necessarily coincident with the output of the pulses and, in fact, generally trails the pulse output by a certain degree. The timing between the initiation of the pulses from the sensor coils and the output pulses will vary in relation to the desired standard control strategy. Thus, although the following figures show the output pulses to the cylinders as being in-line with the pulses from the sensor probes 65, there will be this offsetting which varies with various engine parameters.

Figure 5:
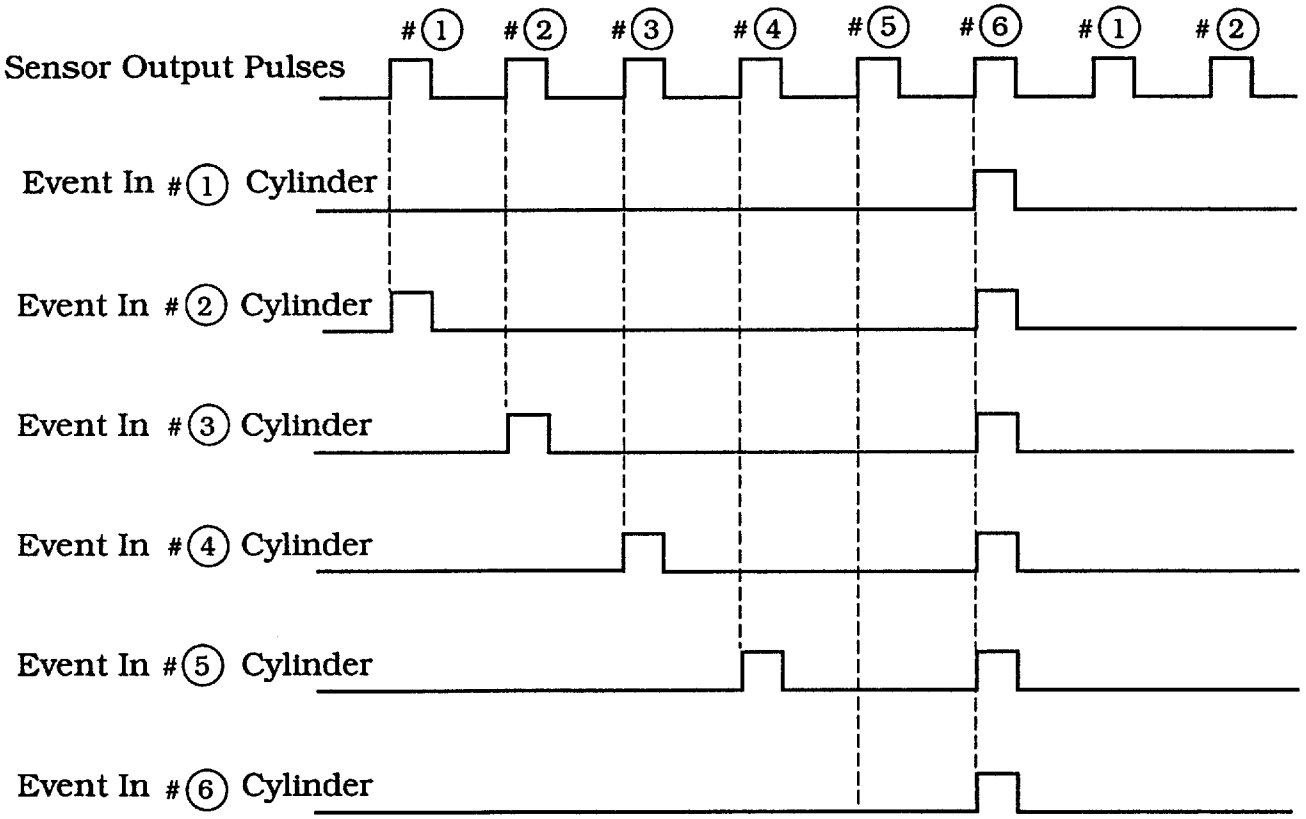
FIG. 5 is a timing diagram, in part similar to FIG. 4, and shows a situation where one of the output sensors does not output a signal, and the corrective action which is taken in accordance with a first embodiment of the invention.

FIG. 5 depicts a situation wherein, for some reason, one of the sensor probes, the probe number 5 in this example, fails to output its signal. This failure may be caused by any of a variety of reasons, such as a failure of the probe itself, a failure in the electrical connections, or a failure in the wire harness 66. As a result, the event in cylinder number 6, i.e., the injection of fuel, will not be appropriately triggered by the output from the probe number 5. The way in which this failure is sensed and the rectifying control strategy will be described by reference to FIG. 6.

Basically, the way the system operates in accordance with this embodiment is that if one probe fails to output a signal, then the events in all cylinders are triggered simultaneously, as shown in FIG. 5. This simultaneous triggering occurs when the next output pulsed from the sensor assembly 64 is received.

The program begins at the step S1 when there is a pulsar output signal from one of the probes 65 of the pulser assembly 64. The program then moves to the step S2 to count the number of crank angles through which the output shaft or crankshaft 27 rotates before the next output signal has been received.

In the illustrated embodiment, the engine 22 is a six-cylinder engine having equal firing impulses. Thus, the sensor probe 65 associated with the respective cylinders should output a signal from the sensor assembly 64 every 60 degrees. Thus, at the step S2, it is determined whether a pulse has occurred in a range of about 80 degrees from the previous pulse. If the pulses do occur at less than this 80 degree angle, then the program moves to the step S3 to provide normal independent fuel injection.

If, however, at the step S2, it is determined that a crank angle rotation of 80 degrees or more has occurred since the last previous pulse, the program then outputs a signal at the step S4 so as to inject from all injectors simultaneously. Thus, pulses are sent to all cylinders, are shown in FIG. 5, under this occurrence.

The program then moves to the step S5 so that the diagnostic monitor 73 reserves a signal indicating which cylinder or cylinder numbers have not had a sensor output pulse.

As the program continues, at the step S6, a determination is made to determine if, on the preceding cycle, that an instance has occurred when fuel has been injected to all cylinders simultaneously. If that has not happened, the program moves to the step S3 so as to continue independent fuel injection for the next cycle.

If, however, there has been simultaneous fuel injection of all injectors for one or more cylinders, the program then moves to the step S7. At the step S7 it is determined if the instantaneous cylinder is one which has been previously skipped on an earlier cycle, as memorized at the step S5. If so, then at that time, all cylinders are injected again at the step S8. The program then ends or repeats.

Thus, if the sensor associated with a single cylinder, or more, is defective in accordance with this control routine, then all cylinders are injected so as to ensure that the engine will run smoothly. Because of the fact that the engine is manifold injected, this simultaneous injection of all cylinders will not cause any significant problems.

Figure 7:
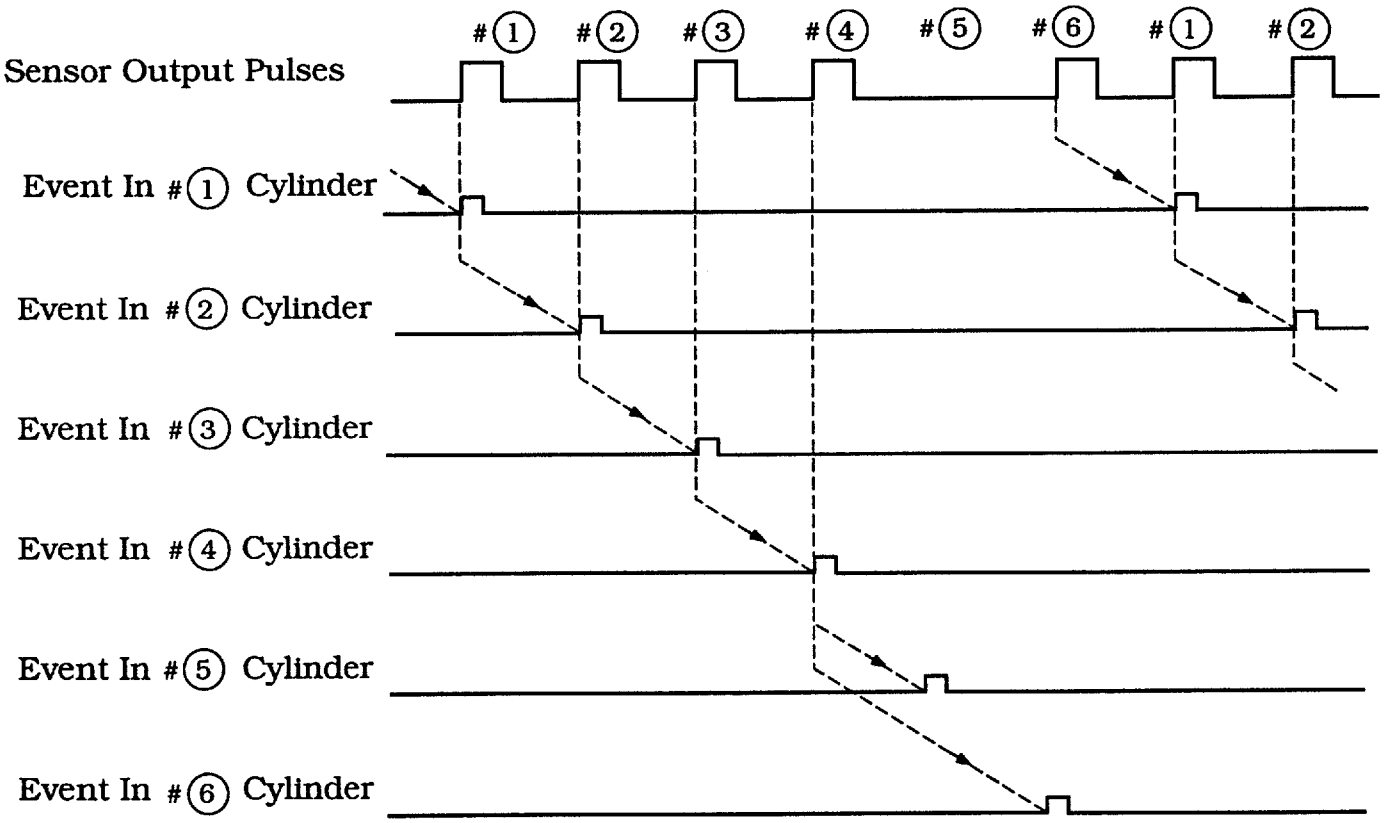
FIG. 7 is a timing diagram, in part similar to FIGS. 4 and 5, and shows another method and system for controlling the timing in the event of failure of a sensor associated with one or more cylinders.
Figure 8:
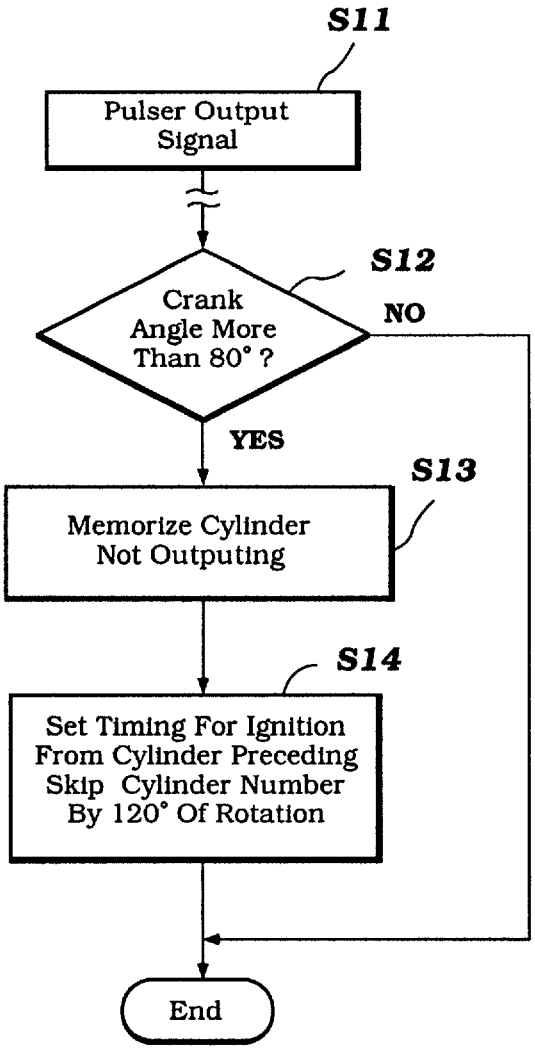
FIG. 8 is a block diagram showing the control methodology employed in conjunction with the method and system shown in FIG. 7.

Although it is acceptable to use simultaneous injection, it is preferred not to use simultaneous ignition. Therefore, another type of control routine may be provided for ignition control in the event of sensor failure, and this is shown in FIGS. 7 and 8. This control routine may also be employed in conjunction with the injection control routine. The method by which the timing of the firing of the spark plugs 48 is controlled in the event there is a failure to output a signal from one of the sensor probes 65 will now be described by reference to FIGS. 7 and 8. It should be noted that although the injection timing is not absolutely critical because of the manifold induction system, this is not completely true with respect to spark timing. Therefore, this control routine has particular utility in conjunction with controlling the spark timing, but it can also be employed in conjunction with injection timing.

In accordance with this control routine, there is provided an arrangement which utilizes the pulser coil 67 as a timing device and outputs timing signals which are added to the previous sensor output signals from the sensor probe 65, so as to provide a timing whereby an adjacent cylinder may be fired at a timing determined by the previously fired cylinder in the event of a sensor failure.

Thus, and referring specifically to FIG. 7, it will be seen that when cylinder number 1 outputs an output pulse, the firing of the spark plug in cylinder number 1 is timed from that output signal. In addition, and as is shown by the broken line, this initiates a counting arrangement whereby the timing for the next cylinder (number 2) may be controlled from the timing of the number 1 cylinder. However, as long as the sensor probe 65 associated with the respective cylinder outputs its signal, the timing for firing of that spark plug is controlled by the sensor probe 65 for the respective cylinder. Thus, when probes 1, 2, 3 and 4 output their signals, the timing of firing of the spark plugs 1, 2, 3 and 4 is determined from those signals.

However, when the probe 65 or sensor associated with cylinder number 5 does not output a signal, then the timing for the firing of spark plug number 5 and, if desired, number 6, may be timed from the output pulses of the sensor from sensor number 4.

Figure 6:
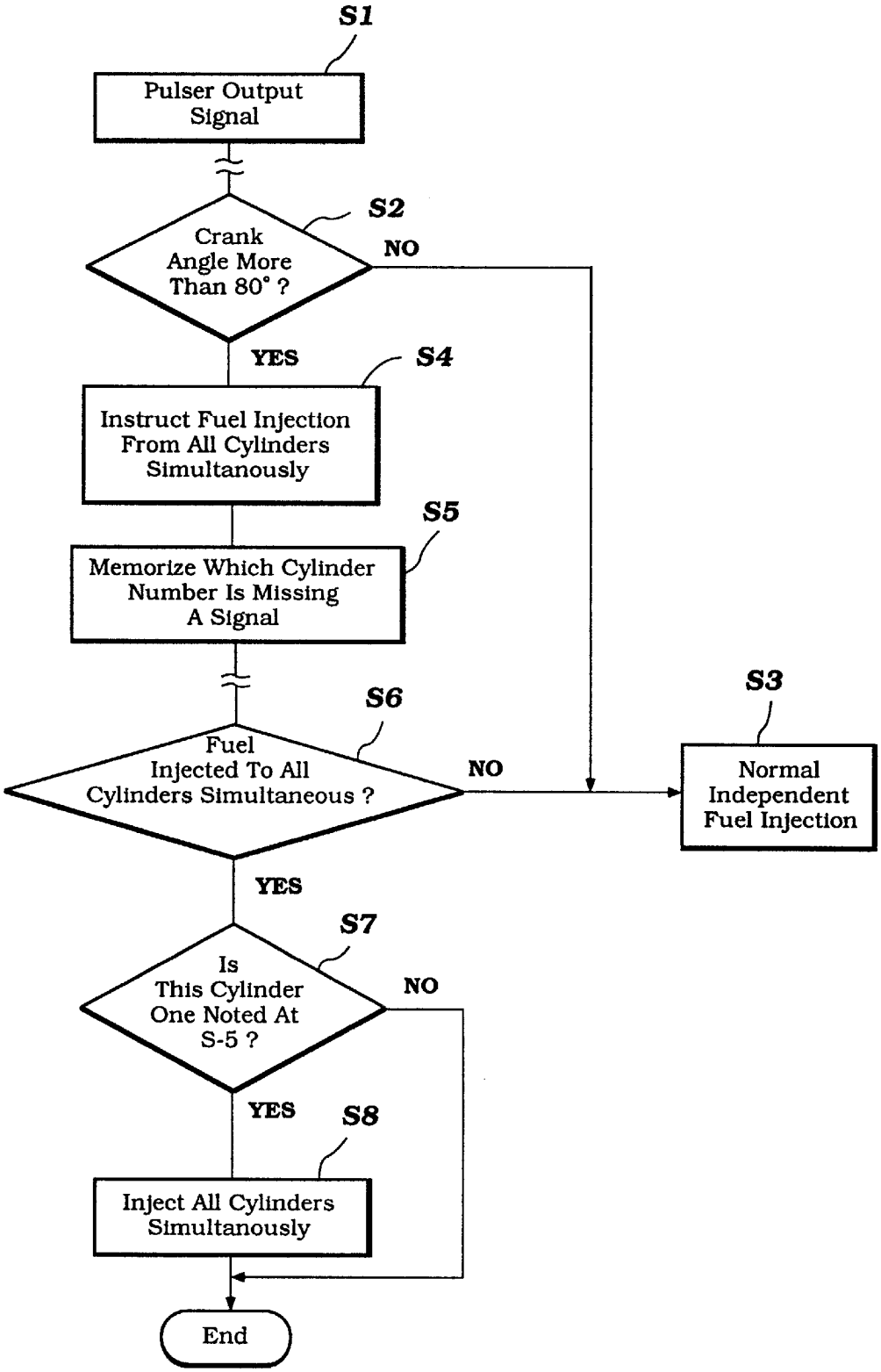
FIG. 6 is a block diagram showing the control routine associated with the method and system of FIG. 5.

Thus, like the control routine of FIG. 6, this program begins at the step S11 to determine existence of the output pulses from the sensor coils. Once a signal is output, at the step S12, a counting step is begun and, as long as the subsequent pulser outputs at signal within 80 degrees of the first signal, the program skips to the end and repeats.

If, however, at the step S12, it is determined that more than 80 degrees of crank angle has elapsed since the previous pulse, the program moves to the step S13. At the step S13, the ECU 49 and specifically, its diagnostic phase 73, determines which cylinder or cylinders have not had output pulses from their sensors.

The program moves to the step S14 so as to set the timing for the skipped cylinder and subsequent cylinders from a cylinder firing 120 degrees before the skipped cylinder. Thus, a preceding cylinder's timing is employed for firing the skipped cylinder and subsequent cylinders, as shown in FIG. 7.

Figure 9:
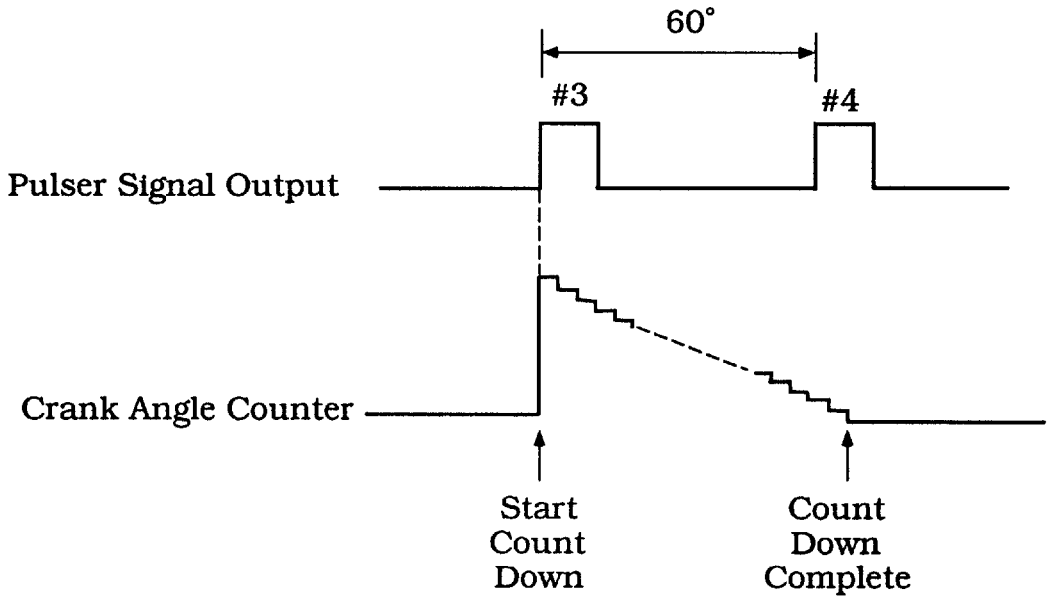
FIG. 9 is a partial timing diagram showing how the timing of the otherwise inoperative cylinder is controlled in conjunction with the embodiment of FIGS. 7 and 8.

The way this can be done is shown in FIG. 9, wherein the output pulse from the cylinder number 3 sensor, which has been previously noted is firing normally, has added to it steps of countdown which are generated from the crank angle sensor 67. Thus, after the number of steps of 60 degrees from the firing of spark plug 3 has been counted, a signal may be generated for the next cylinder so as to fire it.

Thus, the timing of firing of the spark plugs can be accurately determined using the method like a single sensor method, in the event one or more sensors associated with individual cylinders is inoperative. However, in the event that the sensors again output signals, then the system can revert to the more accurate cylinder-by-cylinder control. As noted, this arrangement may also be employed in conjunction with the injection timing.

Figure 10:
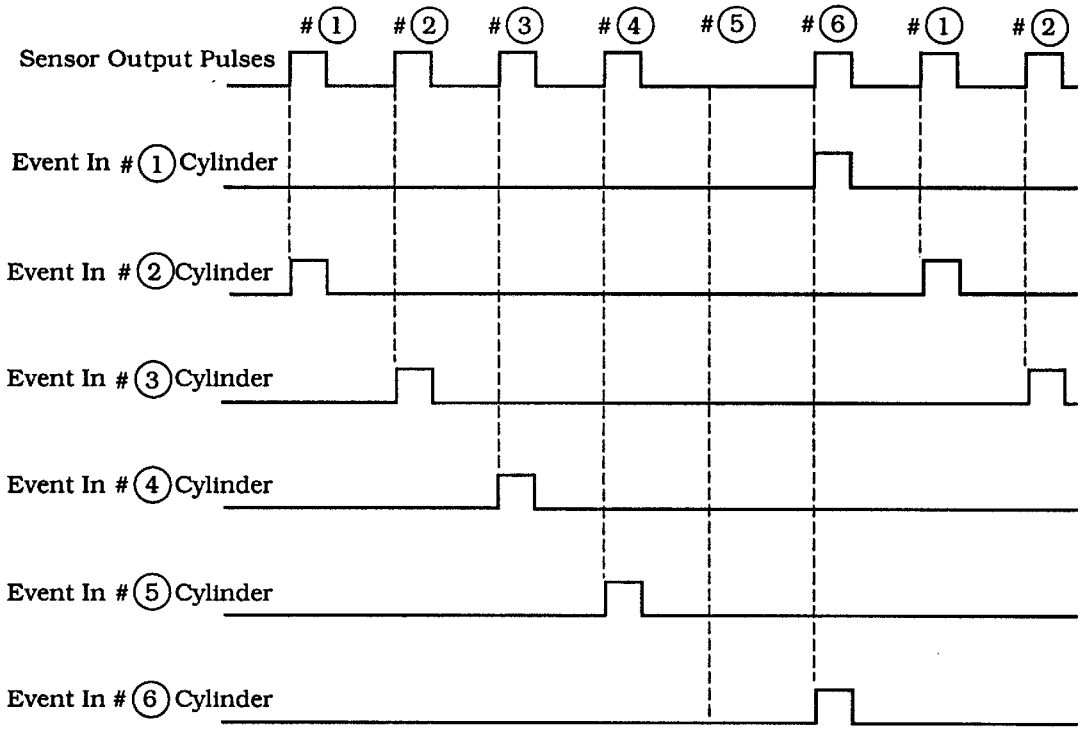
FIG. 10 is a timing diagram, in part similar to FIGS. 4, 5 and 7, and shows another control routine and method for coping with an inoperative sensor output.

In the method described in conjunction with the embodiment of FIGS. 5 and 6, all fuel injectors spray simultaneously in the event a signal is deleted or missed from one of the sensor probes 65 of the sensor assembly 64. As has been noted, this will prove smooth running, but will somewhat increase fuel consumption and exhaust emission. Therefore, in accordance with the embodiment shows in FIGS. 10 and 11, an alternative arrangement is employed wherein the skipped cylinder is injected simultaneously with one other normally operating cylinder.

Thus, as seen in this embodiment, when the output from the pulser 5, which normally triggers the event in cylinder 6, is missed, then the program simultaneously injects for cylinders 1 and 6. Thus, even running will occur without the necessity of having all cylinders injected.

Figure 11:
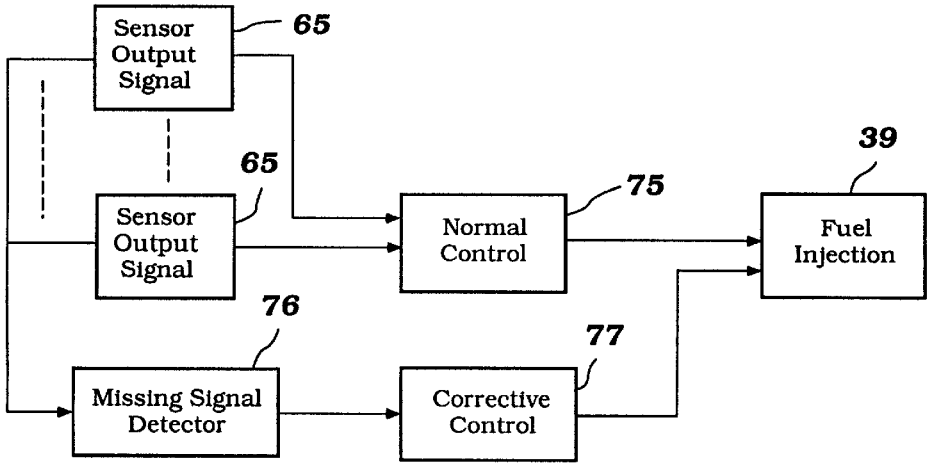
FIG. 11 is a block diagram showing how the elements of this embodiment are interrelated.

The structure for practicing this method is shown schematically in FIG. 11. As may be seen, each sensor probe 65 outputs its signal to a normal control section 75 of the ECU 49 and to a missing signal section 76 of the diagnostic monitor 73. If the monitor 76 senses a missing sensor signal it enables a corrective control 77 which initiates the procedure of FIG. 10.

Thus, from the foregoing description, it should be readily apparent that the described control system and methodology is very effective in ensuring that accurate timing can result for the events in plural cylinders, even running at low speeds when the crankshaft rotational speed may vary significantly during a single revolution. This is done by employing multiple sensors, one for each combustion chamber. If, however, a situation arises wherein one or more of the sensors fails to output a signal, then a control methodology is employed where those affected cylinders can be controlled in response to the output from other normal cylinders, without losing the total benefits of the system.

It should be readily apparent to those skilled in the art that the foregoing description is that of a preferred embodiment of the invention, and that various changes and modifications may be made without departing from the spirit and scope of the invention, as defined by the appended claims.

What is claimed is:

1. A control system for an internal combustion engine having a plurality of combustion chambers, an air charging system for delivering an air charge to said combustion chambers, a fuel system for delivering a fuel charge to said combustion chambers, an ignition system for firing the charge in said combustion chambers, an exhaust system for discharging the burnt charge from said combustion chambers to the atmosphere, an output shaft driven by the combustion in said combustion chambers, at least one of said systems including a plurality of timed components, one for each of said combustion chambers, for effecting a timed event in the portion of the system serving the respective combustion chamber, a plurality of timing sensors associated with said output shaft, one for each of said combustion chambers, means for effecting the timed control of said timed components in response to the output of the respective timing sensor associated with the respective combustion chamber, means for sensing a failure of one of said timing sensors to output a signal at the appropriate time, and means for effecting operation of the timed component of the combustion chamber associated with the inoperative sensor simultaneously with the signal from the timing sensor associated with another of said combustion chambers.

2. A control system as set forth in claim 1, wherein the timed components of all combustion chambers are operated simultaneously in the event a sensor associated with one combustion chamber fails to output its signal.

3. A control system as set forth in claim 1, wherein the time interval between sensor outputs is measured, and when the time interval exceeds the timing interval between the proper sensor outputs by more than a predetermined amount, a sensor output is determined to be defective.

4. A control system as set forth in claim 1, wherein the timed component comprises a fuel supply component associated with each of the combustion chambers as part of the fuel supply system.

5. A control system as set forth in claim 4, wherein the fuel supply component comprises a fuel injector.

6. A control system as set forth in claim 5, wherein the timed components of all combustion chambers are operated simultaneously in the event a sensor associated with one combustion chamber fails to output its signal.

7. A control system as set forth in claim 1, wherein the timed components comprise spark plugs.

8. A control system as set forth in claim 1, wherein the engine is a crankcase compression engine.

9. A control system as set forth in claim 8, wherein the timed component comprises a fuel supply component associated with each of the combustion chambers as part of the fuel supply system.

10. A control system as set forth in claim 9, wherein the fuel supply component comprises a fuel injector.

11. A control system as set forth in claim 10, wherein the fuel injectors inject into an induction system that supplies an air charge to the crankcase chambers of the engine.

12. A control system as set forth in claim 11, wherein the timed components of all combustion chambers are operated simultaneously in the event a sensor associated with one combustion chamber fails to output its signal.

13. A control method for an internal combustion engine having a plurality of combustion chambers, an air charging system for delivering an air charge to said combustion chambers, a fuel system for delivering a fuel charge to said combustion chambers, an ignition system for firing the charge in said combustion chambers, an exhaust system for discharging the burnt charge from said combustion chambers to the atmosphere, an output shaft driven by the combustion in said combustion chambers, at least one of said systems including a plurality of timed components, one for each of said combustion chambers, for effecting a timed event in the portion of the system serving the respective combustion chamber, a plurality of timing sensors associated with said output shaft, one for each of said combustion chambers, said method comprising the steps of effecting the timed control of said timed components in response to the output of the respective timing sensor associated with the respective combustion chamber, sensing a failure of one of said timing sensors to output a signal at the appropriate time, and effecting operation of the timed component of the combustion chamber associated with the inoperative sensor simultaneously with the signal from the sensor associated with another combustion chamber.

14. A control method as set forth in claim 13 wherein the timed components of all combustion chambers are operated simultaneously in the event a sensor associated with one combustion chamber fails to output its signal.

15. A control method as set forth in claim 13 wherein the timed component comprises a fuel supply component associated with each of the combustion chambers as part of the fuel supply system.

16. A control method as set forth in claim 15, wherein the fuel supply component comprises a fuel injector.

17. A control method as set forth in claim 15, wherein the timed components of all combustion chambers are operated simultaneously in the event a sensor associated with one combustion chamber fails to output its signal.

18. A control method as set forth in claim 13, wherein the timed components comprise spark plugs.

19. A control method as set forth in claim 13, wherein the engine is a crankcase compression engine.

20. A control method as set forth in claim 19, wherein the timed component comprises a fuel supply component associated with each of the combustion chambers as part of the fuel supply system.

21. A control method as set forth in claim 20, wherein the fuel supply component comprises a fuel injector.

22. A control method as set forth in claim 21, wherein the fuel injectors inject into an induction system that supplies an air charge to the crankcase chambers of the engine.

23. A control method as set forth in claim 22, wherein the timed components of all combustion chambers are operated simultaneously in the event a sensor associated with one combustion chamber fails to output its signal.

* * * * *